United States Patent [19]

Brine, Jr.

[11] 4,318,544

[45] Mar. 9, 1982

[54] GAME BALL

[75] Inventor: William H. Brine, Jr., Weston, Mass.

[73] Assignee: W. H. Brine Company, Milford, Mass.

[21] Appl. No.: 202,140

[22] Filed: Oct. 30, 1980

[51] Int. Cl.[3] ..... A63B 41/08

[52] U.S. Cl. ..... 273/65 EG; 40/327

[58] Field of Search ..... 273/60 R, 65 EG, 65 EF, 273/58 K, 65 R, 65 E; 40/327

[56] References Cited

U.S. PATENT DOCUMENTS

| | | | |
|---|---|---|---|
| 2,011,760 | 8/1935 | Gallinant | 273/58 K X |
| 2,287,171 | 6/1942 | Goldsmith | 273/65 E G |
| 3,819,190 | 6/1974 | Nepela | 273/232 |

FOREIGN PATENT DOCUMENTS

| | | | |
|---|---|---|---|
| 235 | of 1914 | United Kingdom | 273/65 E |
| 297368 | 6/1927 | United Kingdom . | |
| 657186 | 2/1949 | United Kingdom . | |
| 847885 | 9/1960 | United Kingdom | 273/65 E |
| 1006321 | 9/1965 | United Kingdom | 273/65 EG |
| 1459646 | 7/1974 | United Kingdom . | |
| 221117 | 4/1977 | United Kingdom . | |
| 1555634 | 4/1977 | United Kingdom . | |

*Primary Examiner*—George J. Marlo

*Attorney, Agent, or Firm*—Wolf, Greenfield & Sacks

[57] ABSTRACT

An inflated soccer ball has an inner air bag with a surrounding outer shell. The outer shell is provided with a plurality of indentations arranged so as to provide a wind channel configuration which aids in aerodynamic control of the ball. The wind channel is elongated and extends in at least three different directions.

7 Claims, 2 Drawing Figures

GAME BALL

BACKGROUND OF THE INVENTION

A large variety of game balls are known which are about the size of a soccer ball, are light in weight and are inflated. Control of such balls whether propelled by the hands or feet of the user, presents something of a problem. Often the surfaces of the balls are indented with imprinted materials and the like which tend to imbalance the ball. This imbalance further adds to the difficulty in control. Control relates to making the ball go in the intended direction when it is impelled in a given starting direction, by the hand or feet of the user.

It is known in the art that surface characteristics of a ball can have some affect in direction. For example, in golf balls, it is known that golf ball dimples have sometimes affected direction control. However, insofar as known to the applicants, surface configurations have not been used as a method of adding to the controllability of inflated game balls of the soccer and volleyball type.

SUMMARY OF THE INVENTION

It is an object of this invention to provide an improved game ball having an outer spherical shell which shell is provided with a plurality of wind channels to aid in giving better control to the ball when impelled by the hand or foot of a player.

It is another object of this invention to provide a wind channel means in a game ball surface which does not substantially add to the cost of manufacture, is esthetically pleasing and provides for better handling properties of game balls in an inexpensive and convenient manner.

According to the invention a game ball of the soccer and volleyball type has an inner air chamber with a spherical surrounding outer shell. The outer shell has an outer surface with a plurality of indented wind channel means. Wind channel means is formed by a series of at least three adjacent parallel elongated depressions or channels extending for a channel segment length of at least 1 inch. The series of channels are arranged over the surface in a balanced order and extend in at least three different linear directions angularly arranged with respect to each other. The depressions extend substantially evenly into the surface to a depth of at least 1/16 of an inch. The series are preferably laid out in a plurality of interlocked pentagons where each series forms a part of two adjacent pentagons on the balls. For example, in the preferred embodiment, 12 pentagons are arranged about the surface of a standard soccer ball with each side wall portion of each pentagon comprising seven parallel 1/16 inch depressed channels.

It is a feature of this invention that the wind channel means can be impressed onto to the top surfaces and below such surfaces of various soccer, volley and other inflatable balls with each in standard manufacturing operations. The wind channels provide for better control tending to balance any imbalances caused by printing and other surface characteristics of the balls. The wind channels further provide for a surface which can be kicked against or pushed against by the hand of a user further aiding in control. The wind channels tend to make the balls travel in the original direction imparted by the force of the hand or foot of the player.

BRIEF DESCRIPTION OF THE DRAWINGS

The above and other features, objects and advantages of the present invention will be better understood from a reading of the following specification in conjunction with the drawings in which.

DESCRIPTION OF PREFERRED EMBODIMENTS

Figure 1:
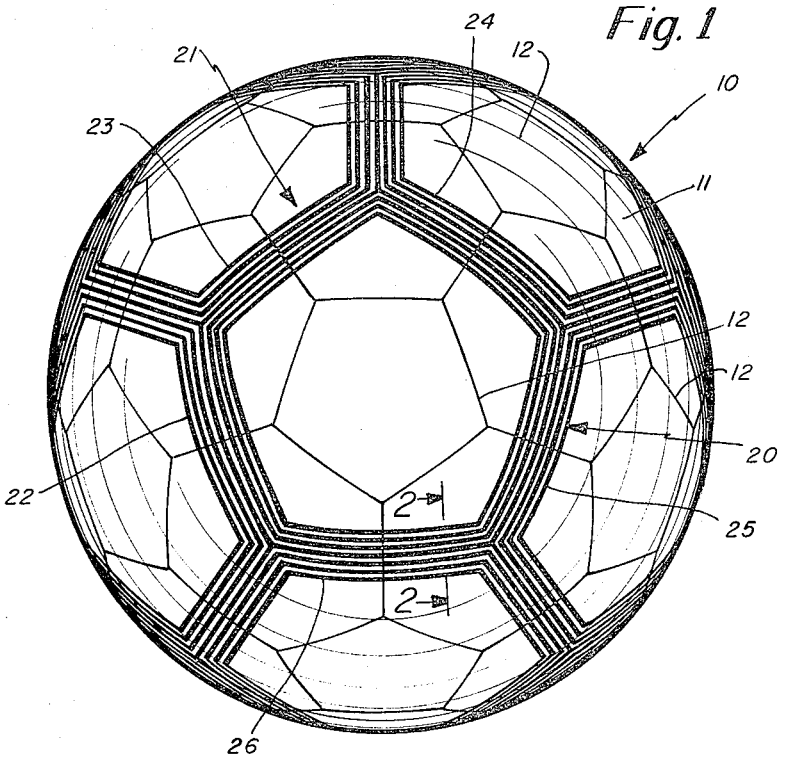
FIG. 1 is a plan view of the front of a soccer ball with the rear not shown being substantially identical thereto.
Figure 2:
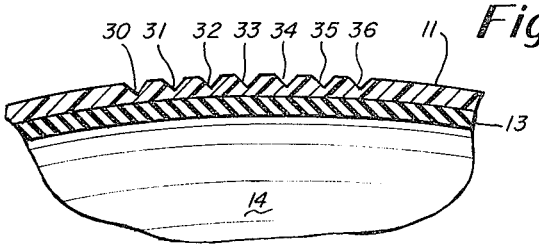
FIG. 2 is a cross sectional view through a portion of a wind channel means carried by the ball.

With reference now to the drawings and more particularly FIG. 1, a soccer ball 10 is shown having an outer synthetic plastic shell 11 formed of pentagon shaped sections 12 arranged over an elastomeric air containing bag 13 which defines an inner chamber 14.

The soccer ball 10 is of conventional construction and can be formed in many ways. Generally, it has a leather or thin plastic outer shell 11 which defines an outer surface shown in FIG. 1.

The shell can be formed of plastic or elastomeric materials such as rubber, polyethylene, polypropylene, vinyl materials and the like as well as of conventional leathers. In all cases, the shell has some thickness which may range from 0.002 to 0.25 inch.

Soccer balls normally have outer diameters of from 20 to 30 inches. The outer shells normally have thicknesses of from 0.005 to 0.25 inches when synthetic organic materials are used as the outer shells.

Problems arise when printed material and the like are imprinted on the sides of soccer balls. Such printing tends to imbalance the balls by causing indentations on one side or another.

The wind channel means are broadly indicated at 20 in FIG. 1 and comprise a plurality of elongated indentations which lie in a series of at least three adjacent parallel elongated depressions. V shaped indentations are shown, although U shaped cross section indentations are preferred to maximize the stabilizing effect of the channels. The depressions or channels extend for segment lengths of at least 1 inch and are arranged over the surface of the ball in a balanced order. The channels can be V, U or other cross sectional shapes. The segments extend in at least three different linear directions angularly arranged with respect to each other. In a preferred form, a soccer ball of standard size, has normal pentagon shaped sections making up its surface. These sections form the outer shell and are indented by 12 pentagon design arrangement indicated generally at 21 each having 5 segments in a series forming the pentagon arrangement 22–26 each segment having seven elongated depressions 30,31,32,33,35 and 36. Each of the segments 22–26 are identical and comprise molded indentations in the surface of the shell which may extend through to the undersurface of the shell, but in most embodiments merely comprise depressions in the upper surface 11. These parallel elongated depressions or channels have a depth of at least 1/16 inch and in the preferred embodiment are $\frac{1}{8}$ inch deep with a width about equal to the depth. Preferably the width equals the depth in a U shaped cross section, thus the width is at least 1/16 inch. The depressions are uniform throughout the ball in the preferred embodiment and provide a large plurality of elongated lines of at least two inches in length. The segments which form the wind channel are preferably arranged to uniformly overlie and encompass equal areas of underlying pentagon shapes of the shell 12 so as to balance the shell pentagons therein as best shown in FIG. 1. U shaped cross sections are preferred since they create greater turbulence at the surface of the ball than does V shaped cross sections. It is preferred that the sidewalls of the channels be parallel to each other to enhance the turbulence.

The lines formed by the depressions act to give better control to the ball. They provide a surface to kick or hit against with the foot or hand. Thus the ball can be given backspin which aids in control. Moreover, the wind channels may act to direct air passing through them and give aerodynamic balance to the ball. The channels tend to overcome any imbalance in the ball from impressions made between the shell pentagons sections or normal printing operations in the ball. Because the segments are evenly distributed throughout the top surface of the ball, a significant overall balance with regard to handling characteristics occurs.

Because the channels are arranged in different directions with respect to any axis through the ball, as the ball spins, the lines provided by the wind channels direction; yet, overall act to stabilize passage of the ball through the air.

While the number of depressions in each segment can vary, at least three are provided in order to give the requisite control, surface enhancement and other characteristics of the balls of this invention. While pentagons are preferred, since they provide five different angular directions for the wind channel means of each design section, other regular polygonal arrangements can be used.

When a pentagon is used, the series or sides of the pentagon are at 72 degree angles to each other. Thus as the ball travels through the air, plurality of angularly arranged series cut into the air tending to keep the ball along a true path in the direction it was originally propelled in by the player.

While a specific embodiment in this invention has been shown and described, many variations are possible. Soccer balls are particularly suitable for applications of the wind channel means of this invention. This is due to their size and overall weight. Other balls of similar nature for games such as volleyball, basketball and the like can also be treated with the wind channels means of this invention to advantage.

While the depressions are preferably formed in the top surface of the ball, in some instances, the depressions can be corrugations through the material or depressions having bottoms which extend through and distort the undersurface of the shell can be used. In all cases it is desired to provide parallel channel segments which present air or wind passage means to air as the ball is propelled through the air by the foot or hand power of a user.

What is claimed is:

1. A game ball having an inner air chamber and a spherical surrounding outer shell, said outer shell comprising an outer surface having a plurality of indented wind channel means extending in at least three different linear directions angularly arranged with respect to each other, each of said wind channel means comprising at least three adjacent parallel elongated depressions extending for a segment length of at least 1 inch, and said plurality of wind channel means being arranged over said surface in a balanced order and acting to aid in improved aerodynamic balance to said ball.

2. A game ball in accordance with claim 1 with said depressions extending substantially uniformly into said surface to a depth of at least 1/16 inch.

3. A game ball in accordance with claim 2 with said series laid out in the form of a plurality of interlocked pentagons.

4. A game ball in accordance with claim 3 wherein 12 pentagon shapes are uniformly arranged over the surface of said ball and said ball is a soccer ball.

5. A game ball in accordance with claim 4 wherein said 12 pentagons overlie uniformly a plurality of pentagon shaped sections in the surface of said soccer ball.

6. A game ball in accordance with claim 1 wherein said wind channel means has substantially parallel sidewalls.

7. A game ball in accordance with claim 1 wherein said wind channel means has a U shaped cross section with the walls having a depth equal to the width of the cross section.

* * * * *

UNITED STATES PATENT AND TRADEMARK OFFICE

CERTIFICATE OF CORRECTION

PATENT NO. : 4,318,544

DATED : March 9, 1982

INVENTOR(S) : William H. Brine, Jr.

It is certified that error appears in the above—identified patent and that said Letters Patent is hereby corrected as shown below:

Column 3, line 22, please insert --change-- between "channels" and "di-".

Signed and Sealed this

*Eighth* Day of *June 1982*

[SEAL]

*Attest:*

GERALD J. MOSSINGHOFF

*Attesting Officer*

*Commissioner of Patents and Trademarks*